US008033243B2

(12) United States Patent
Bolyard, Jr. et al.

(10) Patent No.: US 8,033,243 B2
(45) Date of Patent: Oct. 11, 2011

(54) STRAND POSITIONING GUIDE HAVING REVERSELY ORIENTED V-SHAPED SLOTS FOR USE IN CONNECTION WITH STRAND COATING APPLICATORS

(75) Inventors: Edward W. Bolyard, Jr., Old Hickory, TN (US); Mel Steven Lessley, Villa Hills, KY (US)

(73) Assignee: Illinois Tool Works Inc., Glenview, IL (US)

( * ) Notice: Subject to any disclaimer, the term of this patent is extended or adjusted under 35 U.S.C. 154(b) by 875 days.

(21) Appl. No.: 11/819,903

(22) Filed: Jun. 29, 2007

(65) Prior Publication Data

US 2009/0000545 A1 Jan. 1, 2009

(51) Int. Cl.
*B05C 5/00* (2006.01)
*B05C 3/12* (2006.01)

(52) U.S. Cl. ..... 118/325; 118/305; 118/307

(58) Field of Classification Search ..... 118/305, 118/307, 325; 242/472.8, 347
See application file for complete search history.

(56) References Cited

U.S. PATENT DOCUMENTS

| | | | | |
|---|---|---|---|---|
| 2,841,020 | A | 7/1958 | Van Deventer, IV | |
| 2,899,339 | A | 8/1959 | Rakus | |
| 2,911,941 | A * | 11/1959 | Sokal | 118/708 |
| 2,997,017 | A * | 8/1961 | Steele | 118/78 |
| 3,029,161 | A * | 4/1962 | Ferner | 427/350 |
| 3,125,126 | A | 3/1964 | Engels | |
| 3,667,846 | A | 6/1972 | Nater et al. | |
| 3,821,543 | A * | 6/1974 | Gelin et al. | 242/472.8 |
| 4,044,250 | A | 8/1977 | Fetzer | |
| 4,215,939 | A | 8/1980 | Miller et al. | |
| 4,389,024 | A | 6/1983 | Sanders | |
| 4,458,152 | A | 7/1984 | Bonora | |
| 4,687,477 | A | 8/1987 | Suzuki et al. | |
| 4,750,960 | A | 6/1988 | Bubeck | |
| 4,842,666 | A | 6/1989 | Werenicz | |
| 4,984,440 | A | 1/1991 | McCall | |
| 5,525,175 | A * | 6/1996 | Blenke et al. | 156/161 |
| 5,660,664 | A | 8/1997 | Hermann | |
| 5,735,788 | A | 4/1998 | Yasutake et al. | |
| 5,766,411 | A | 6/1998 | Wilson | |
| 5,902,540 | A | 5/1999 | Kwok | |
| 5,964,973 | A | 10/1999 | Heath et al. | |
| 6,077,375 | A | 6/2000 | Kwok | |
| 6,200,635 | B1 | 3/2001 | Kwok | |
| 6,520,237 | B1 | 2/2003 | Bolyard, Jr. et al. | |
| 6,582,518 | B2 | 6/2003 | Riney | |
| 6,613,146 | B2 | 9/2003 | Bolyard, Jr. | |
| 7,067,009 | B2 | 6/2006 | Bolyard, Jr. et al. | |
| 2003/0079681 | A1 * | 5/2003 | Hardy | 118/300 |
| 2003/0200921 | A1 * | 10/2003 | Crane et al. | 118/420 |
| 2005/0274318 | A1 * | 12/2005 | Bolyard et al. | 118/325 |

OTHER PUBLICATIONS

Non-Woven Systems, Nordson Corporation, 1998. ITW Dynatec, Integra System.

* cited by examiner

*Primary Examiner* — Dah-Wei Yuan
*Assistant Examiner* — Charles Capozzi
(74) *Attorney, Agent, or Firm* — Law Offices of Steven W. Weinrieb

(57) ABSTRACT

Strand positional guide implements, for use in connection with hot melt adhesive strand coating applicator assemblies, comprise a plurality of V-shaped strand guide slots wherein the apex portions are oriented outwardly away from the hot melt adhesive material dispensing nozzles. Accordingly, an enlarged air space is effectively defined between the plurality of elongated strands and its respective hot melt adhesive material dispensing nozzle such that the plurality of elongated strands are not adversely affected by the heat or thermal radiation generated by or emanating from the hot melt adhesive material dispensing nozzles thereof.

20 Claims, 6 Drawing Sheets

STRAND POSITIONING GUIDE HAVING REVERSELY ORIENTED V-SHAPED SLOTS FOR USE IN CONNECTION WITH STRAND COATING APPLICATORS

FIELD OF THE INVENTION

The present invention relates generally to strand coating systems or applicator assemblies, and more particularly to new and improved strand positioning guide implements for use in connection with strand coating applicators, wherein the strand guide positioning implements are provided with reversely oriented V-shaped grooves or guide slots which not only serve to properly position and orient a plurality of elongated, parallel strands which are being respectively positionally guided beneath a plurality of material dispensing nozzles in such a manner that the plurality of elongated, parallel strands can assuredly be respectively aligned in a coplanar manner with respect to the plurality of material dispensing nozzles whereby the dispensed material, such as, for example, hot melt adhesive, can be simultaneously dispensed from the plurality of material dispensing nozzles and properly applied to and coated upon the elongated strands so as to ensure the desirable adherence of the plurality of elongated strands upon particular substrates, but in addition, the reverse orientation of the V-shaped grooves or guide slots space or separate the elongated strands from the applicator module dispensing nozzles through means of predetermined distances such that the strands are not thermally affected in an adverse manner by means of heat emanating from the applicator module. In addition, the reverse orientation of the V-shaped grooves or guides slots facilitates the disposition or location of the strand tensioning mechanisms and the routing or disposition of the applicator power cables or air conduits.

BACKGROUND OF THE INVENTION

Various, different material dispensing and coating systems or apparatus, for simultaneously coating a plurality of elongated, parallel strands with suitable materials, such as, for example, hot melt adhesives, are of course known in the art. Dispensing and coating systems or apparatus, of the aforenoted type, are disclosed, for example, within U.S. Pat. No. 7,067,009 which issued on Jun. 27, 2006 to Bolyard, Jr. et al., U.S. Pat. No. 6,613,146 which issued on Sep. 2, 2003 to Bolyard, Jr., U.S. Pat. No. 6,520,237 which issued on Feb. 18, 2003 to Bolyard, Jr. et al., U.S. Pat. No. 6,200,635 which issued on Mar. 13, 2001 to Kwok, and U.S. Pat. No. 6,077,375 which issued on Jun. 20, 2000 to Kwok. In addition to the aforenoted patents, a similar system or apparatus is disclosed within U.S. patent application Ser. No. 10/623,294 which was filed on Jul. 18, 2003 in the name of M. Steve Lessley et al. More particularly, as disclosed within FIG. 1, which corresponds substantially to FIG. 2 of the aforenoted patent application, a strand coating system or applicator assembly is generally indicated by the reference character 200, and it is seen that the strand coating system or applicator assembly 200 comprises an adhesive dispensing device 210 which is fixedly mounted upon a module assembly 220. The module assembly 220 is, in turn, fixedly mounted upon a head 240, and a pair of strands 233,235, to be coated with a suitable adhesive material discharged from a pair of nozzles or orifices defined within the adhesive dispensing device 210, are conveyed from a suitable strand supply roll, not shown, over a strand guide member or roller 230, which is mounted upon a pair of positionally adjustable arms 236,238 and within which a pair of strand guide grooves 232,234 are defined, and downwardly past the nozzles or orifices defined within the adhesive dispensing device 210.

In order to ensure the fact that the strands 233, 235 are conveyed past the nozzles or orifices, defined within the adhesive dispensing device 210, in a desired manner or mode wherein the strands 233,235 will be properly coated with the adhesive material, a pair of cylindrical, strand guide pins 250,252 are mounted upon a mounting plate 254 which, in turn, is fixedly mounted upon the module assembly 220. More particularly, the provision, presence, or disposition of the pair of cylindrical, strand guide pins 250,252 ensures the fact that the strands 233,235 will be moved past, or aligned with, the nozzles or orifices, defined within the adhesive dispensing device 210, in a substantially coplanar manner or mode with respect to the nozzles or orifices such that the adhesive material, dispensed or discharged from the nozzles or orifices defined within the adhesive dispensing device 210, will in fact be properly deposited or coated upon the strands 233, 235. More particularly, it can be readily appreciated still further that in order for the aforenoted adhesive material coating operation to be properly performed in connection with the strands 233,235, the strands 233,235 must be disposed upon, or conveyed along, the internal portions of the pair of cylindrical, strand guide pins 250,252, that is, the strands 233,235 must be conveyed in a substantially tangential manner along those portions of the cylindrical strand guide pins 250,252 which effectively face, or are disposed toward, each other. If the strands 233,235 are disposed upon or conveyed along the external portions of the pair of cylindrical strand guide pins 250,252, that is, those portions of the cylindrical, strand guide pins 250,252 which effectively face, or are disposed, away from each other, then the strands 233,235 will not be properly aligned, in the aforenoted coplanar manner or mode, with respect to the nozzles or orifices defined within the adhesive dispensing device 210.

It can be readily appreciated still further, however, that due to the circular symmetry defined by means of the cylindrical strand guide pins 250,252, the strands 233, 235 can in fact be easily or readily conveyed either in a tangential manner upon or along the internal portions of the pair of cylindrical strand guide pins 250,252 that effectively face, or are disposed, toward each other, or alternatively, the strands 233, 235 can likewise be easily or readily conveyed in a tangential manner along or upon the external portions of the pair of cylindrical strand guide pins 250, 252 that effectively face, or are disposed, away from each other. Obviously, if the strands 233, 235 are erroneously or mistakenly routed so as to be tangentially conveyed along or upon the external portions of the pair of cylindrical strand guide pins 250,252 which effectively face, or are disposed, away from each other, the strands 233, 235 will not be properly aligned or disposed in the aforenoted coplanar manner or mode with respect to the nozzles or orifices defined within the adhesive dispensing device 210. Accordingly, the adhesive material, dispensed or discharged from the nozzles or orifices, defined within the adhesive dispensing device 210, will not in fact be properly deposited upon the strands 233,235 in accordance with required or desired deposition techniques or patterns. This will be quite detrimental to the overall adhesive coating process because the system must obviously be shut down while the strand routing problem is effectively corrected. In addition, those elongated strands, already having the adhesive material deposited or coated thereon in a relatively defective manner, must be discarded as waste in view of the fact that such strands cannot be readily rerouted for reprocessing because any adhesive material already deposited thereon, albeit in an improper mode or pattern, would tend to foul the overall strand coating system 200.

In order to rectify the aforenoted potential difficulties characteristic of the hot melt adhesive dispensing apparatus utilizing such cylindrical strand guide pins, the strand guide system, as disclosed within FIG. 2, which effectively corresponds to FIG. 2 of U.S. Pat. No. 7,067,009, employs V-shaped strand guide slots. More particularly, the strand guide system 310 comprises a module assembly 312 that controls the supply of the hot melt adhesive material and the control air or other gas to a hot melt adhesive material dispensing assembly 314, and it is seen that a plurality of hot melt adhesive material dispensing nozzles 316 are arranged or disposed within a horizontal array within the hot melt adhesive material dispensing assembly 314. The hot melt adhesive material dispensing nozzles 316 are adapted to dispense and discharge hot melt adhesive material which is to be deposited onto and coated upon a plurality of laterally spaced material strands 322 which are to be subsequently adhered to or upon one or more substrates, not shown. A strand guide implement or block 324 is fixedly mounted upon a vertically oriented mounting plate 326 which, in turn, is fixedly mounted upon the front face of the module assembly 312, and a plurality of laterally spaced substantially V-shaped strand guide slots 328 are defined within the strand guide implement or block 324 so as to effectively extend rearwardly from a front face or surface 330 of the strand guide implement or block 324 whereby the apex portions 332 of the substantially V-shaped strand guide slots 328 are disposed in a recessed manner internally within the strand guide implement or block 324.

It can additionally be appreciated that each one of the apex portions 332 effectively forms a seat within or upon which each one of the plurality of elongated strands 322 is adapted to be disposed or seated. Accordingly, when each one of the plurality of elongated strands 322 is inserted into a respective one of the plurality of guide slots 328, the convergent side walls of each one of the substantially V-shaped guide slots 328 will effectively cause each one of the elongated strands 322 to be disposed or seated upon the apex seat portion 332 of its respective V-shaped strand guide slot 328 in view of the rearward biasing of the elongated strands 322 as determined, for example, by means of the disposition of a strand supply roll, not shown, and a product assembly station, also not shown. In this manner, it can be seen that each one of the plurality of elongated strands 322 is effectively laterally constrained or confined within its respective one of the substantially V-shaped guide slots 328, and that each one of the plurality of apex seat portions 332 of the plurality of substantially V-shaped strand guide slots 328 is respectively vertically aligned in a substantially coplanar manner with a respective one of the plurality of hot melt adhesive material dispensing nozzles 316. Accordingly, it is thereby ensured that each one of the elongated strands 322 will be conveyed within the common plane defined by means of respective ones of the apex seat portions 332 of the plurality of substantially V-shaped strand guide slots 328 and the plurality of hot melt adhesive material dispensing nozzles 316, and therefore, as hot melt adhesive material is dispensed and discharged from each one of the hot melt adhesive material dispensing nozzles 316, and deposited upon each one of the vertically oriented elongated strands 322, the elongated strands 322 will be properly coated with the hot melt adhesive material.

While the aforenoted strand guide system 310, as disclosed within FIG. 2, has proven to be an operational advancement with respect to the strand guide system 250,252, as disclosed within FIG. 1, it is noted that as a result of the rearward disposition or orientation of the V-shaped guide slots 328 with respect to the front face or surface 330 of the strand guide implement or block 324, whereby the plurality of strands 322 will be disposed at positions closest to the hot melt adhesive material dispensing assembly 314 and the hot melt adhesive material dispensing nozzles 316 thereof as a result of being disposed upon the apex seat portions 332 of the plurality of substantially V-shaped strand guide slots 328, the strands 322 could possibly be adversely affected by means of the heat or thermal radiation generated by or emanating from the hot melt adhesive material dispensing assembly 314 and the hot melt adhesive material dispensing nozzles 316 thereof. In addition, it is not always logistically possible to position the strand supply roll, the product assembly station, or the various electrical power or air conduits, operatively associated with the hot melt adhesive applicator apparatus, in such a manner that the rearward bias of the strands 322 is able to be readily achieved.

A need therefore exists in the art for new and improved strand positional guide implements or mechanisms, for use in connection with hot melt adhesive material dispensing and coating nozzles of strand coating applicators, wherein the strand positional guide implements or mechanisms will not only serve to properly position a plurality of elongated, parallel strands with respect to the plurality of the material dispensing and coating nozzles, in such a manner that the plurality of elongated, parallel strands can assuredly be respectively aligned in a coplanar manner with respect to the plurality of material dispensing and coating nozzles whereby the dispensed and discharged materials, such as, for example, hot melt adhesives, can be simultaneously dispensed and discharged from the plurality of material dispensing and coating nozzles and properly applied to or coated upon the elongated, parallel strands prior to the adherence of the elongated strands upon suitable substrates so as to ensure the adherence of the plurality of elongated strands upon the particular substrates when the elongated strands and the substrates are mated together in order to form completed fabricated products, but in addition, the strand positional guide implements or mechanisms will space or separate the plurality of elongated strands from the plurality of material dispensing and coating nozzles such that the plurality of strands will not be adversely affected by means of the heat or thermal radiation generated by or emanating from the hot melt adhesive material dispensing assembly and the hot melt adhesive material dispensing nozzles thereof.

SUMMARY OF THE INVENTION

The foregoing and other objectives are achieved in accordance with the principles and teachings of the present invention through the provision of a new and improved strand positional guide implements or mechanisms, for use in connection with material dispensing and coating nozzles of, for example, hot melt adhesive strand coating applicator assemblies, wherein the strand positional guide implements or mechanisms comprise a plurality of strand guide slots which not only have substantially V-shaped cross-sectional configurations, but in addition, the apex portions of the V-shaped strand guide slots are disposed outwardly or remotely away from the hot melt adhesive material dispensing assembly and the hot melt adhesive material dispensing nozzles thereof. In this manner, an enlarged air space is effectively defined between each one of the plurality of elongated strands and its respective hot melt adhesive material dispensing nozzle such that the plurality of elongated strands are not adversely affected by means of the heat or thermal radiation generated by or emanating from the hot melt adhesive material dispensing assembly and the hot melt adhesive material dispensing nozzles thereof. The V-shaped strand guide slots are defined within the strand positional guide implements or blocks, and a plurality of insertion slots are also defined within the strand positional guide implements or blocks so as to permit the plurality of elongated strands to be inserted into the respective V-shaped strand guide slots. Alternatively, the strand positional guide implement or block comprises a cantilevered structure integrally attached at one end thereof to a mounting plate, which is to be fixedly secured to the applicator module, whereby the strands may initially be inserted between the strand positional guide implement or block and the mounting plate, and then subsequently inserted into the individual V-shaped strand guide slots.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 3:
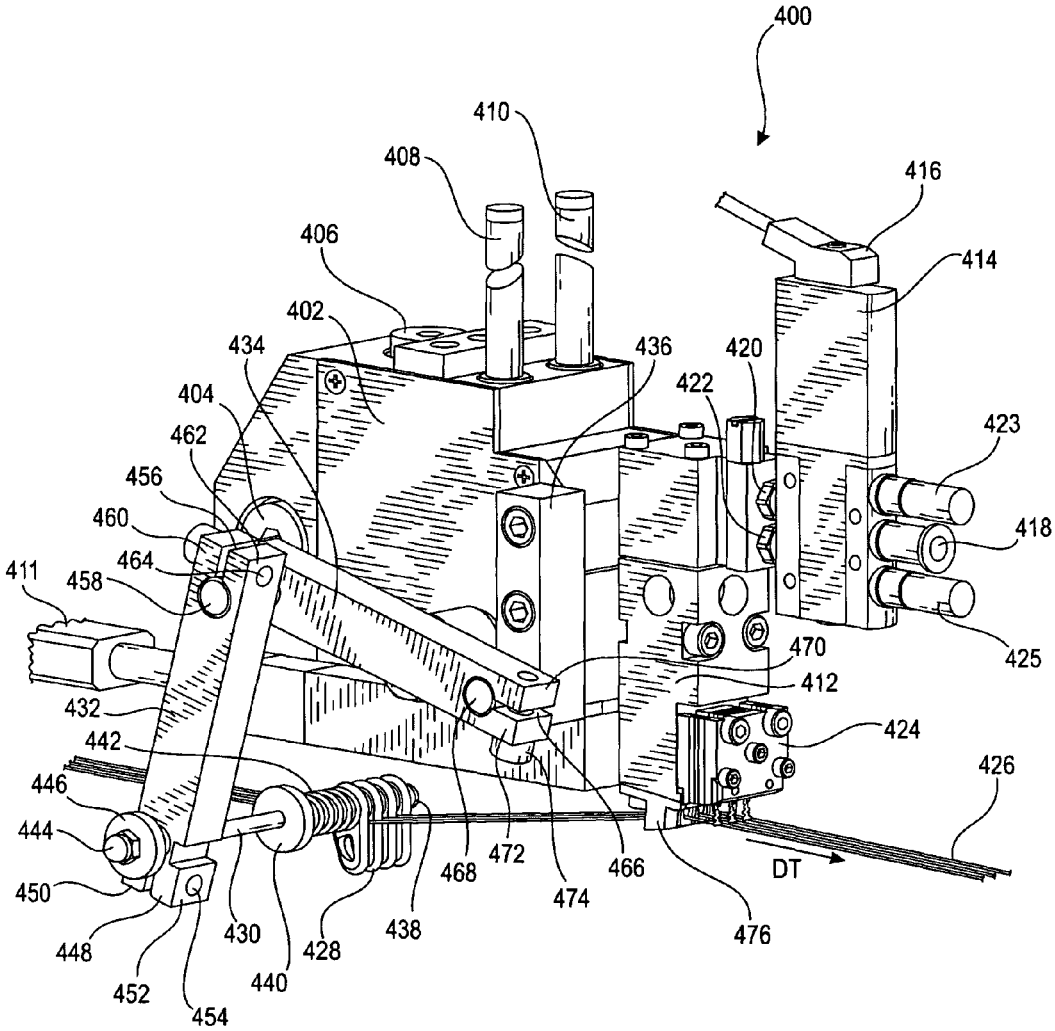
FIG. 3 is a perspective view of a new and improved strand applicator assembly having operatively incorporated therewithin a new and improved strand positional guide implement as constructed in accordance with the principles and teachings of the present invention.

Referring now to the drawings, and more particularly to FIG. 3 thereof, a new and improved strand applicator assembly, as constructed in accordance with the principles and teachings of the present invention, is disclosed and is generally indicated by the reference character 400. More particularly, it is seen that the new and improved strand applicator assembly 400 comprises an applicator head 402 to which, for example, hot melt adhesive material is to be supplied by means of a suitable hose or conduit, not shown, which can be operatively connected to the applicator head 402 by means of either one of, for example, two hose inlet ports 404 or 406 which are respectively formed within left side and upper surface portions of the applicator head 402. The applicator head 402 also has a hot melt adhesive material temperature sensor connector or assembly 408 and an electrical power control connector or assembly 410, for the applicator heater and ground connections, operatively connected to the upper surface portion of the applicator head 402, and an electrical connector assembly 411 for operating the air heater for heating the air operatively or fluidically associated with the hot melt adhesive material. Still yet further, a module assembly 412 is adapted to be mounted upon the front face or surface portion of the applicator head 402, and the module assembly 412 has a solenoid valve assembly 414 operatively connected to an upper front face or surface portion thereof.

Electrical power is provided for the solenoid valve assembly 414 by means of a suitable electrical connector 416, and a control air inlet conduit 418 is operatively connected to the solenoid valve assembly 414 so as to provide control air into the solenoid valve assembly 414. Upper and lower control air outlet fittings 420,422 are interposed between the solenoid valve assembly 414 and the module assembly 412 such that when the solenoid valve assembly 414 is suitably actuated, control air is conducted to an appropriate one of the control air outlet fittings 420,422 in order to, in turn, actuate a dispensing valve, not shown, disposed within the module assembly 412. The module assembly 412 has a dispensing nozzle assembly 424, comprising a plurality of hot melt adhesive material dispensing nozzles, fixedly mounted upon the front face or surface portion thereof, and accordingly, depending upon the alternative fluidic control or routing of the incoming control air, by means of the solenoid valve assembly 414, to a particular one of the control air outlet fittings 420,422, the dispensing valve, not shown, disposed within the module assembly 412 will be operatively moved between an upper or raised OPENED position so as to permit the dispensing of the hot melt adhesive material from the dispensing nozzle assembly 424 and the dispensing nozzles thereof, and a lower CLOSED position so as to prevent the dispensing of the hot melt adhesive material from the dispensing nozzle assembly 424 and the dispensing nozzles thereof. Upper and lower mufflers 423,425 are operatively associated with the solenoid valve assembly 414 so as to effectively dampen any noise generated by means of the solenoid valve assembly 414.

The hot melt adhesive material being dispensed from the dispensing nozzle assembly 424, and being respectively dispensed from the plurality of dispensing nozzles thereof, is adapted to be deposited onto a plurality of strands 426 which are being conveyed, for example, beneath the plurality of dispensing nozzles of the dispensing nozzle assembly 424 in the illustrated direction of travel DT. The plurality of strands 426 are supplied from a suitable supply source, not shown, and are adapted to be respectively routed through a plurality of transversely spaced strand conveyance guides 428 which are mounted upon a transversely oriented support arm 430 that is pivotally mounted upon a first lower end portion of a first positioning arm 432. The first positioning arm 432 is, in turn, pivotally mounted at its second upper end portion upon a first rearwardly disposed end portion of a second positioning arm 434, and the second forwardly disposed end portion of the second positioning arm 434 is pivotally mounted upon a vertically oriented mounting block 436 that is fixedly mounted upon the applicator head 402.

More particularly, it is seen, for example, that in connection with the pivotal mounting of the transversely oriented support arm 430 upon the lower end portion of the first positioning arm 432, the transversely oriented support arm 430 is externally threaded, and a first cap nut 438 is mounted upon the free or distal end portion of the externally threaded support arm 430. The plurality of transversely spaced strand conveyance guides 428 are mounted upon the externally threaded support arm 430 such that the right-most one of the plurality of strand conveyance guides 428 abuts the first cap nut 438, and a first thumb-nut 440 is also threadedly engaged upon the externally threaded support arm 430. A coil spring 442 is interposed between the first thumb-nut 440 and the left-most one of the plurality of strand conveyance guides 428, and in this manner, as a result of the threaded adjustment of the first thumb-nut 440 upon the externally threaded support arm 430 such that the first thumb-nut 440 engages, and tends to axially compress, the coil spring 442, forces can be transmitted to the plurality or array of strand conveyance guides 428 whereby the plurality of strand conveyance guides 428 will be maintained at their illustrated angular positions upon the support arm 430. The opposite or proximal end portion of the support arm 430 is seen to be mounted within the lower end portion of the first positioning arm 432 and is provided with a second cap nut 444 as well as a second thumb-nut 446. In addition, it is also seen that the first lower end portion of the first positioning arm 432 is split or bifurcated by means of a slot 448 which effectively intersects the bore through which the support arm 430 passes, and that axially aligned portions of another bore, not visible, are respectively provided within the split sections 450,452 of the lower bifurcated end portion of the first positioning arm 432 so as to accommodate a first externally threaded clamping bolt 454. It is to be appreciated that a first one of the axially aligned portions of the bore defined within the first one of the split or bifurcated sections 450 of the lower end portion of the first positioning arm 432 is non-threaded, while a second one of the axially aligned portions of the bore defined within the second one of the split or bifurcated sections 452 of the lower end portion of the first positioning arm 432 is threaded.

In this manner, as the first externally threaded clamping bolt 454 is passed through the first non-threaded one of the axially aligned portions of the bore, and threadedly engaged within the second internally threaded one of the axially aligned portions of the bore in a predeterminedly tightened mode, the first externally threaded clamping bolt 454 will effectively force or cause the internally threaded section 452 of the lower bifurcated end portion of the first positioning arm 432 to move toward the non-threaded section 450 of the lower bifurcated end portion of the first positioning arm 432 so as to effectively clamp and capture the support arm 430 in a fixed manner and thereby prevent pivotal or rotational movement of the first positioning arm 432 with respect to the support arm 430. On the other hand, relative rotation or pivotal movement of the support arm 430, with if respect to the first positioning arm 432, is permitted, for example, for angular adjustment purposes, when the first externally threaded clamping bolt 454 is untightened and subsequently re-tightened.

In a similar manner, it is seen that the second upper end portion of the first positioning arm 432 is likewise split or bifurcated by means of a slot 456 which effectively intersects a bore through which a first pivot pin 458 passes, the first pivot pin 458 being fixedly mounted within the rearwardly disposed end portion of the second positioning arm 434 and thereby serving to pivotally mount the second upper end portion of the first positioning arm 432 upon the rearwardly disposed end portion of the second positioning arm 434. Axially aligned portions of a bore, not visible, are respectively provided within the split sections 460,462 of the second upper bifurcated end portion of the first positioning arm 432 so as to accommodate a second externally threaded clamping bolt 464, and it is to be appreciated that a first one of the axially aligned portions of the bore defined within the first one of the split or bifurcated sections 460 of the lower end portion of the first positioning arm 432 is non-threaded, while a second one of the axially aligned portions of the bore defined within the second one of the split or bifurcated sections 462 of the lower end portion of the first positioning arm 432 is threaded. In this manner, when the second externally threaded clamping bolt 464 is inserted through the first non-threaded one of the axially aligned portions of the bore, and threadedly engaged within the second internally threaded one of the axially aligned portions of the bore in a predeterminedly tightened mode, the second externally threaded clamping bolt 464 will effectively force or cause the internally threaded section 462 of the upper bifurcated end portion of the first positioning arm 432 to move toward the non-threaded section 460 of the upper bifurcated end portion of the first positioning arm 432 so as to effectively clamp and capture the first pivot pin 458 in a fixed manner and thereby prevent pivotal or rotational movement of the first positioning arm 432 with respect to the second positioning arm 434. On the other hand, relative rotation or pivotal movement of the first positioning arm 432, with respect to the second positioning arm 434, is permitted, for example, for angular adjustment purposes, when the second externally threaded clamping bolt 464 is untightened and subsequently re-tightened.

Still yet further, and likewise in a similar manner, it is seen that the forwardly disposed end portion of the second positioning arm 434 is split or bifurcated by means of a slot 466 which effectively intersects a bore through which a second pivot pin 468 passes, the second pivot pin 468 being fixedly mounted within the vertically oriented mounting block 436 and thereby serving to pivotally mount the forwardly disposed end portion of the second positioning arm 434 upon the vertically oriented mounting block 436. Axially aligned portions of a bore, not visible, are respectively provided within the split sections 470,472 of the forwardly disposed bifurcated end portion of the second positioning arm 434 so as to accommodate a third externally threaded clamping bolt 474, and it is to be appreciated that a first one of the axially aligned portions of the bore defined within the first one of the split or bifurcated sections 470 of the forwardly disposed end portion of the second positioning arm 434 is non-threaded, while a second one of the axially aligned portions of the bore defined within the second one of the split or bifurcated sections 472 of the forwardly disposed end portion of the second positioning arm 434 is threaded. In this manner, when the third externally threaded clamping bolt 474 is inserted through the first non-threaded one of the axially aligned portions of the bore, and threadedly engaged within the second internally threaded one of the axially aligned portions of the bore in a predeterminedly tightened mode, the third externally threaded clamping bolt 474 will effectively force or cause the internally threaded section 470 of the forwardly disposed bifurcated end portion of the second positioning arm 434 to move toward the non-threaded section 472 of the forwardly disposed bifurcated end portion of the second positioning arm 434 so as to effectively clamp and capture the second pivot pin 468 in a fixed manner and thereby prevent pivotal or rotational movement of the second positioning arm 434 with respect to the vertically oriented mounting block 436. On the other hand, relative rotation or pivotal movement of the second positioning arm 434, with respect to the vertically oriented mounting block 436, is permitted, for example, for angular adjustment purposes, when the third externally threaded clamping bolt 474 is untightened and subsequently re-tightened.

With reference still being made to FIG. 3, it is further seen that in order to properly route the plurality or array of strands 426 beneath the hot melt adhesive dispensing nozzles of the dispensing nozzle assembly 424, a strand positioning guide implement or mechanism 476, in the form of a guide block, is fixedly mounted upon the underside portion of the module assembly 412. More particularly, as can best be appreciated from FIGS. 4 and 5, a first exemplary embodiment of a new and improved strand positioning guide implement or mechanism 576, as constructed in accordance with the principles and teachings of the present invention and showing the cooperative parts thereof, and which may be utilized, for example, in conjunction with the strand applicator assembly 400 at the position illustrated by means of the strand positioning guide implement or mechanism 476 mounted upon the underside portion of the module assembly 412, is disclosed. It is seen that the first exemplary embodiment strand positioning guide implement or mechanism 576 comprises a substantially horizontally oriented mounting plate 578 which is provided with a pair of laterally or transversely spaced through-bores 580, defined within a rear end portion of the mounting plate 578, in order to permit suitable bolt fasteners, not shown, to fixedly secure the mounting plate 578, and the entire strand positioning guide implement or mechanism 576, to the underside or undersurface portion of the module assembly 412. In addition, it is also seen that the strand positioning guide implement or mechanism 576 comprises a substantially vertically oriented strand positioning guide block 582 wherein a plurality of laterally or transversely spaced strand positioning guide slots 584 are defined within the strand positioning guide block 582 so as to extend therethrough for respectively guiding, for example, the plurality of strands 426.

Continuing further, it is also noted that different kinds of strands 426 may be utilized within a particular hot melt adhesive deposition or coating process or procedure. For example, the strands 426 may be fabricated from a suitable material, such as, for example, LYCRA®, elastic rubber, wire, cable, or any elongated member onto which it is desirable to deposit a coating material, and are adapted to be used in connection with the fabrication or manufacture of various different products, such as, for example, diapers, incontinence pads or garments. Depending upon the particular material utilized to fabricate or manufacture the strands 426, the strands 426 may have the tendency to stick to each other or to adhere together, and accordingly, it is also known in the art to utilize, for example, talc, or another similar material, substance, composition, or the like, to initially coat the strands 426 in order to in fact effectively prevent the strands 426 from sticking together.

It has been experienced, however, that the talc or other similar material tends to accumulate upon the exit side of the strand positioning guide block 582 as the plurality of strands 426 are conveyed in the direction of travel DT toward the plurality of dispensing nozzles comprising the dispensing nozzle assembly 424. Care must therefore be taken to effectively prevent the talc or other similar material from accumulating upon the strand positioning guide implement or mechanism 576 to such a degree that the same interferes with the dispensing or discharge of the hot melt adhesive material from the plurality of dispensing nozzles comprising the dispensing nozzle assembly 424 whereby the accurate or precise, and timely, dispensing of the hot melt adhesive material, from the plurality of the dispensing nozzles comprising the dispensing nozzle assembly 424, would be adversely affected.

Figure 4:
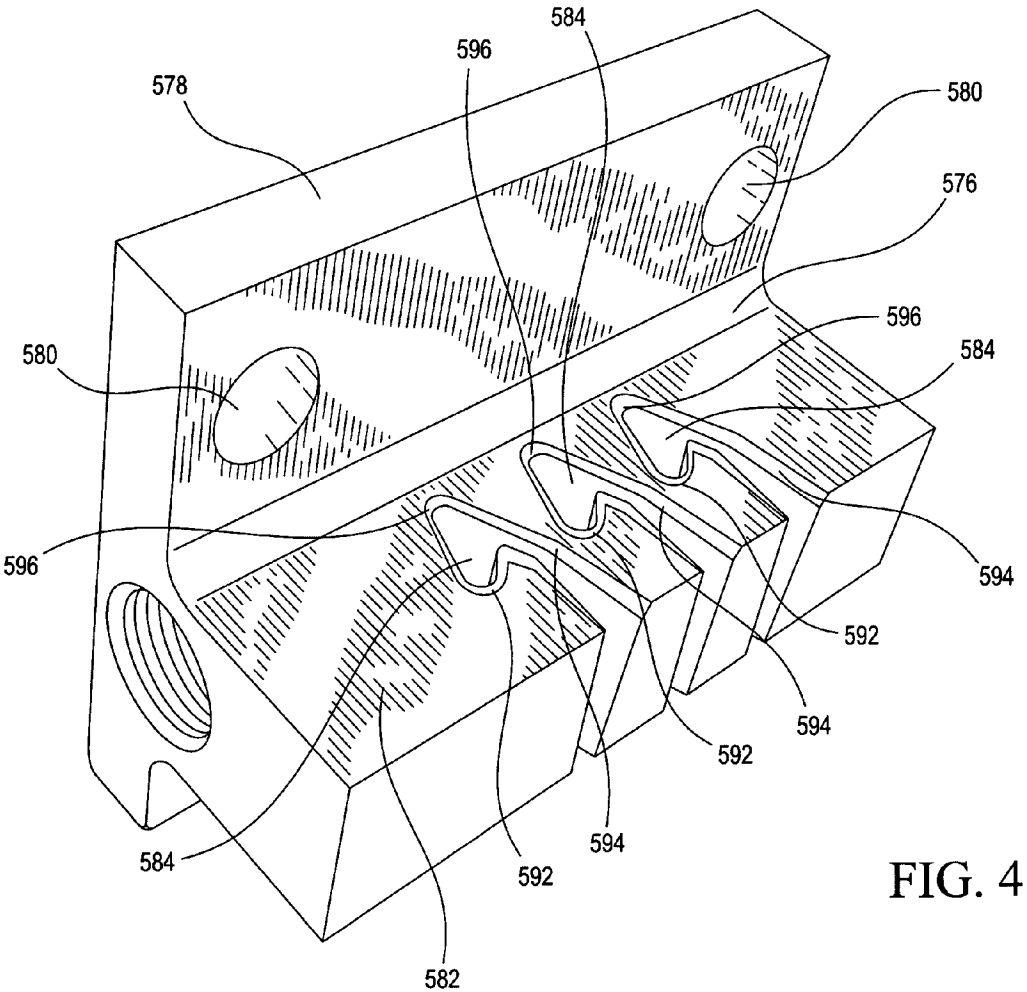
FIG. 4 is a rear perspective view of a first embodiment of a new and improved strand positioning guide implement as constructed in accordance with the principles and teachings of the present invention and showing the cooperative parts thereof.
Figure 5:
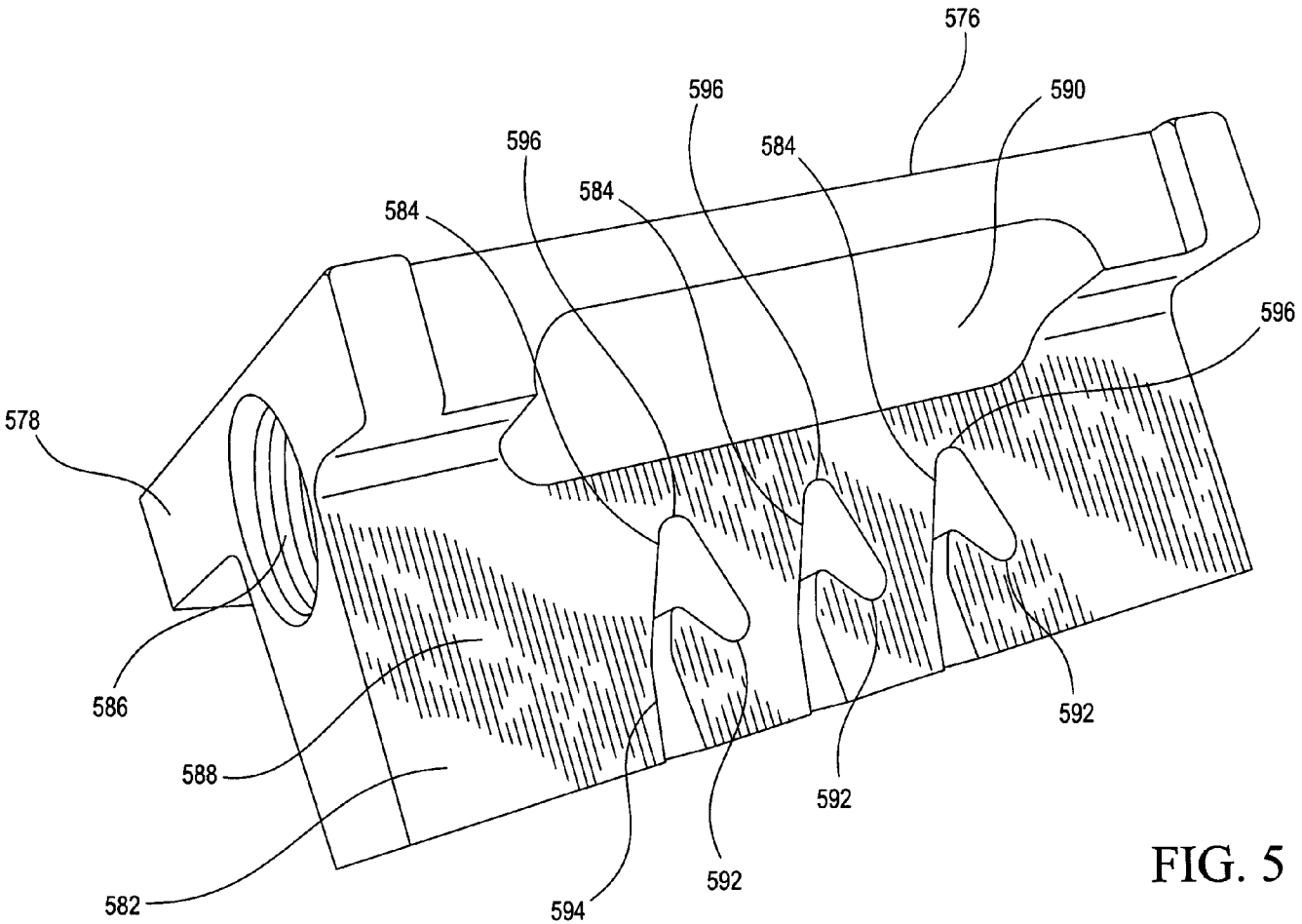
FIG. 5 is a front perspective view of the first embodiment strand positioning guide implement as disclosed within FIG. 4.

Therefore, as can best be appreciated from FIGS. 4 and 5, the strand positioning guide implement or mechanism 576 is provided with a transversely oriented threaded bore 586 to which suitable vacuum apparatus, not shown, can be fixedly connected whereby the transversely oriented bore 586 will effectively become a vacuum passageway. In addition, as can best be seen from FIG. 5, the front face 588 of the vertically oriented strand positioning guide block 582 is provided with a transversely oriented elongated inlet port 590 which is fluidically connected to the vacuum passageway 586, and it can be further appreciated from FIG. 5, as well as from FIG. 3 which illustrates the orientation of the strand positioning guide implement or mechanism 476 upon the undersurface portion of the module assembly 412, that the transversely oriented elongated inlet port 590 would be located immediately upstream of the plurality of the dispensing nozzles comprising the dispensing nozzle assembly 424.

Accordingly, the vacuum generated within the vacuum passageway 586, and effectively fluidically conveyed to the elongated inlet port 590, will serve to effectively remove, and thereby prevent the accumulation of, excess talc or similar material upon the front face 588 of the strand positioning guide block 582, as the plurality of strands 426 are respectively conveyed through the strand positioning guide slots 584 defined within the strand positioning guide block 582. In this manner, the talc or similar material cannot adversely interfere with, foul, block, occlude, or obstruct the dispensing or discharge of the hot melt adhesive material from the plurality of the dispensing nozzles comprising the dispensing nozzle assembly 424.

Continuing still further, and in accordance with further unique and novel structural features characteristic of the first embodiment strand positioning guide implement or mechanism 576 as constructed in accordance with the principles and teachings of the present invention, it is seen that each one of the plurality of strand positioning guide slots 584 has a substantially V-shaped configuration wherein the plurality of V-shaped strand positioning guide slots 584 are oriented in such a manner that the apex portion 592 of each one of the plurality of V-shaped strand positioning guide slots 584 is oriented or points downwardly. In this manner, when the strand positioning guide implement or mechanism 576 is mounted upon the undersurface portion of the module assembly 412 by means of the mounting plate 578, the apex portions 592 of the plurality of V-shaped strand positioning guide slots 584, within which the plurality of strands 426 will actually be positioned, will be disposed within a common plane which is located relatively remotely from the plane within which the plurality of dispensing nozzles, comprising the dispensing nozzle assembly 424, are disposed. Accordingly, the plurality of strands 426 will, in turn, be spaced or separated from the plurality of dispensing nozzles, comprising the dispensing nozzle assembly 424, so as to effectively be located relatively remotely from the plurality of dispensing nozzles, comprising the dispensing nozzle assembly 424.

Figure 1:
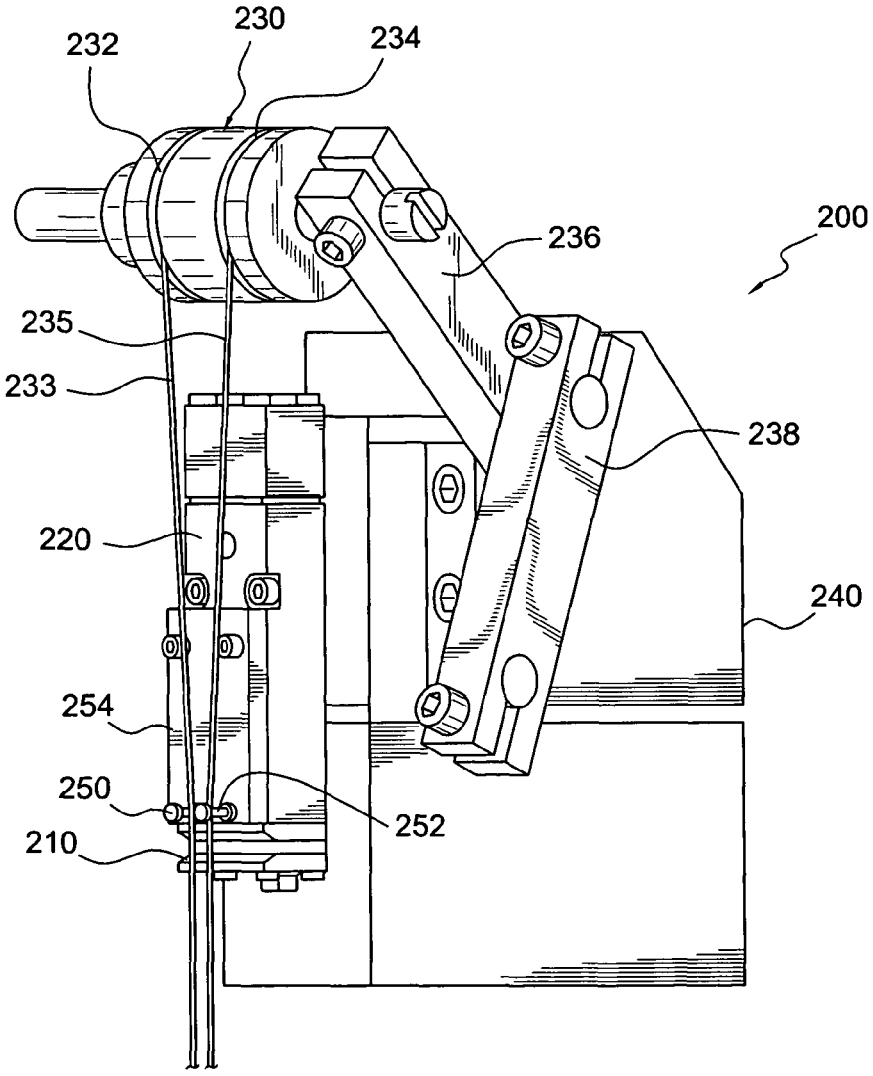
FIG.1 (PRIOR ART)
FIG. 1 is a perspective view of a first conventional, PRIOR ART strand guide system that uses cylindrical, strand guide pins as the strand guide implements or mechanisms.
Figure 2:
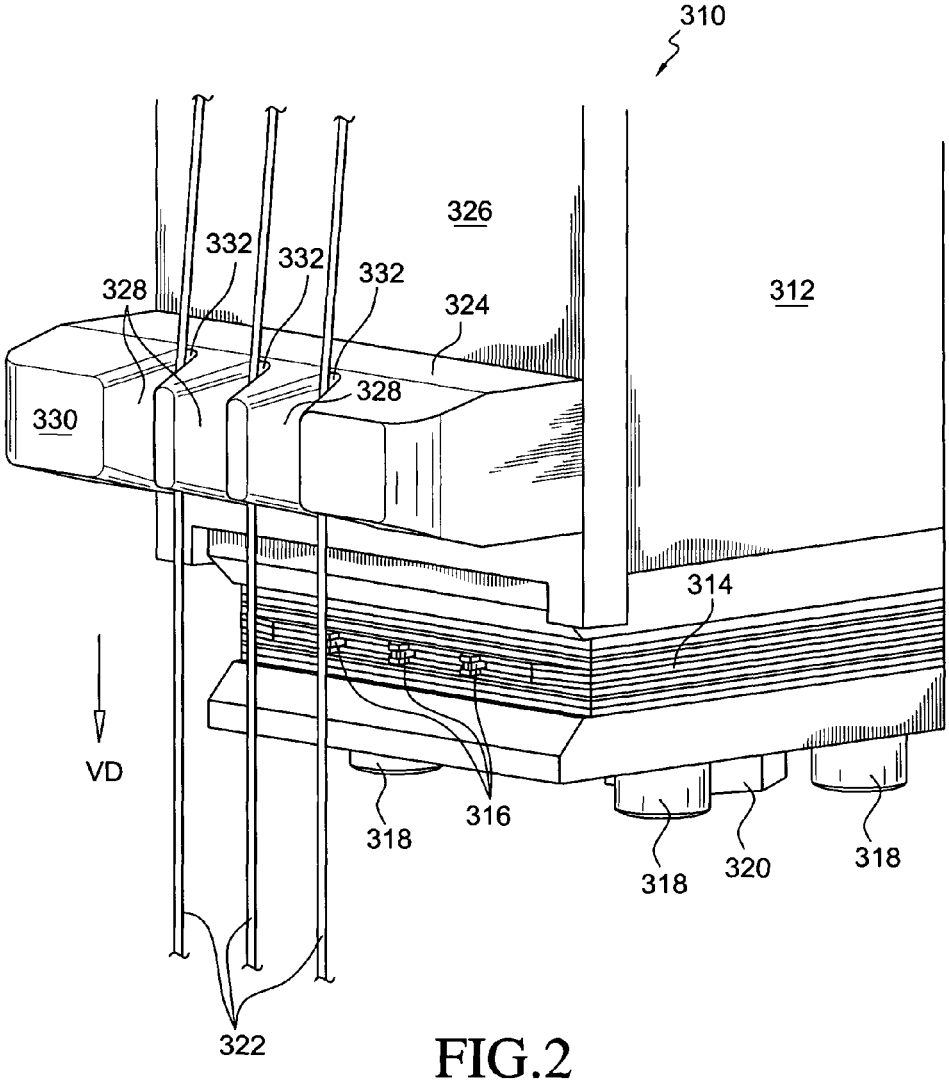
FIG.2 (PRIOR ART)
FIG. 2 is a perspective view of a second conventional, PRIOR ART strand guide system that uses V-shaped strand guide slots wherein the apex portions of the V-shaped strand guide slots are disposed closest to the hot melt adhesive material dispensing assembly and the hot melt adhesive material dispensing nozzles thereof.

Considered from a somewhat alternative perspective or point of view, it can be appreciated, for example, that in accordance with the disclosure and teachings of U.S. Pat. No. 7,067,009, the V-shaped strand guide slots 328, as illustrated within FIG. 2, are oriented in such a manner that the apex portions 332 thereof, within which the plurality of strands 322 are seated, are disposed within a common plane which is located at the closest possible distance with respect to the common plane within which the plurality of hot melt adhesive dispensing nozzles 316 are located. To the contrary, however, in accordance with the principles and teachings of the present invention, it can readily be appreciated that the V-shaped strand guide slots 584, as illustrated in FIGS. 4 and 5, are defined within the strand positioning guide block 582 so as to have a reversed orientation wherein the apex portions 592 thereof, within which the plurality of strands 426 are adapted to be seated, are disposed within a common plane which is located at a substantially remote or farthest possible distance with respect to the common plane within which the plurality of hot melt adhesive dispensing nozzles of the dispensing nozzle assembly 424 are located.

In this manner, it can be appreciated that the plurality of strands will not be adversely affected by means of the heat or thermal radiation generated by or emanating from the hot melt adhesive material dispensing nozzle assembly 424 and the hot melt adhesive material dispensing nozzles thereof, or considered alternatively, that any likelihood of the plurality of strands being adversely affected by means of the heat or thermal radiation generated by or emanating from the hot melt adhesive material dispensing nozzle assembly 424 and the hot melt adhesive material dispensing nozzles thereof will effectively be minimized. In addition, it is also noted that as a result of the aforenoted reversed orientation of the V-shaped strand guide slots 584, wherein the apex portions 592 of the strand positioning guide slots 584 are oriented, or point, away from the plurality of dispensing nozzles comprising the dispensing nozzle assembly 424, the strand supply roll, the product assembly station, or the various electrical power or air conduits, operatively associated with the hot melt adhesive applicator apparatus, may be positioned or located at more advantageous positions or locations with respect to the applicator apparatus, in accordance, for example, with available special logistics characteristic of a particular facility, in view of the fact that, for example, the strands 426 are now biased downwardly or away from the plurality of dispensing nozzles comprising the dispensing nozzle assembly 424 in lieu of being biased upwardly or toward the plurality of dispensing nozzles comprising the dispensing nozzle assembly 424. It is lastly seen that in order to effectively provide access to the V-shaped strand guide slots 584 whereby the strands 426 may be positioned and seated within the reversely oriented apex portions 592 thereof, the strand positioning guide block 582 is also provided with a plurality of substantially vertically oriented insertion slots 594 which are respectively connected to the plurality of V-shaped strand guide slots 584 through means of a plurality of upper interconnecting routing portions 596 which have substantially inverted U-shaped rounded configurations so as to smoothly or easily route the strands 426 from the insertion slots 594 into the guide slots 584.

Figure 6:
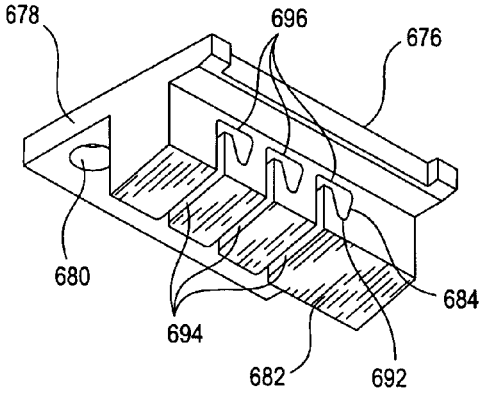
FIG. 6 is a front perspective view of a second embodiment of a new and improved strand positioning guide implement as constructed in accordance with the principles and teachings of the present invention and showing the cooperative parts thereof.
Figure 7:
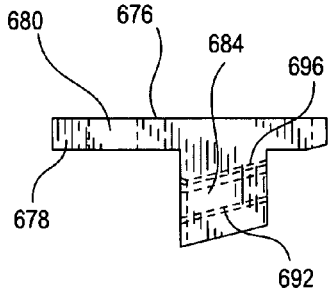
FIG. 7 is a side elevational view of the second embodiment strand positioning guide implement as illustrated within FIG. 6.

With reference now being made to FIGS. 6 and 7, a second embodiment of a new and improved strand positioning guide implement or mechanism 676, as constructed in accordance with the principles and teachings of the present invention and showing the cooperative parts thereof, and which may likewise be utilized, for example, in conjunction with the strand applicator assembly 400 at the position illustrated by means of the strand positioning guide implement or mechanism 476 mounted upon the underside portion of the module assembly 412, is disclosed. It is noted that the second embodiment strand positioning guide mechanism or implement 676 is similar to the first embodiment strand positioning guide mechanism or implement 576 as illustrated within FIGS. 4 and 5, except as will be noted hereinafter, and therefore the discussion of the second embodiment strand positioning guide mechanism or implement 676 will be confined to the differences between the second embodiment strand positioning guide mechanism or implement 676 and the first embodiment strand positioning guide mechanism or implement 576. In addition, it is also noted that component parts of the second embodiment strand positioning guide mechanism or implement 676, which correspond to similar component parts of the first embodiment strand positioning guide mechanism or implement 576, will be designated by corresponding reference characters except that they will be within the 600 series.

More particularly, one of the differences between the second embodiment strand positioning guide mechanism or implement 676, as compared to the first embodiment strand positioning guide mechanism or implement 576, is that the transversely oriented bore or vacuum passageway 586, and the fluidically connected transversely oriented elongated inlet port 590, of the first embodiment strand positioning guide mechanism or implement 576 has been eliminated from the second embodiment strand positioning guide mechanism or implement 676. This structure therefore simplifies the manufacture of the second embodiment strand positioning guide mechanism or implement 676, although it is to be appreciated that the second embodiment strand positioning guide mechanism or implement 676 would then only be effectively useable in connection with the routing or guidance of strands 426 which were fabricated from a suitable material which not effectively necessitate the coating thereof with talc or similar material. In addition, it is also noted that in lieu of the plurality of upper interconnecting routing portions 596 characteristic of the first embodiment strand positioning guide mechanism or implement 576, the upper or internal ceiling portions 696 of the second embodiment strand positioning guide mechanism or implement 676 comprise substantially horizontally oriented planar surfaces.

Figure 8:
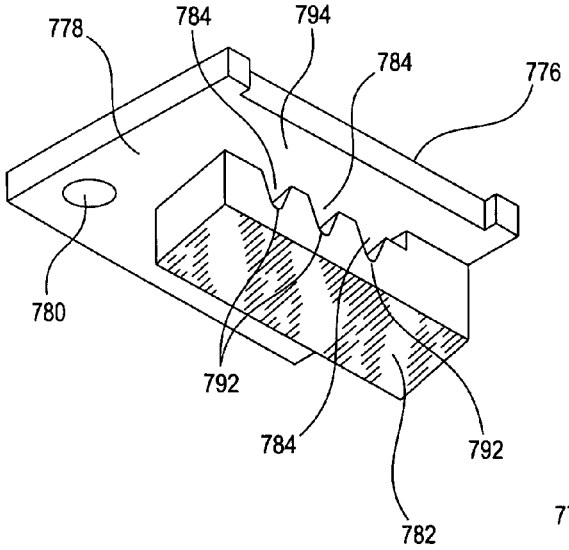
FIG. 8 is a front perspective view of a third embodiment of a new and improved strand positioning guide implement as constructed in accordance with the principles and teachings of the present invention and showing the cooperative parts thereof.
Figure 9:
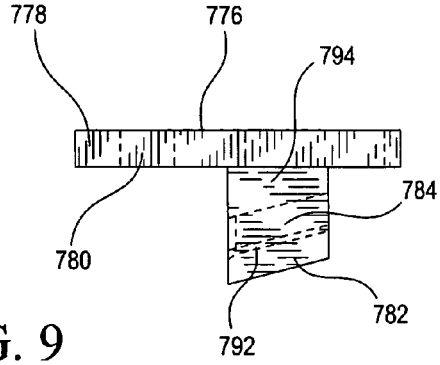
FIG. 9 is a side elevational view of the third embodiment strand positioning guide implement as illustrated within FIG. 8.

With reference lastly being made to FIGS. 8 and 9, a third embodiment of a new and improved strand positioning guide implement or mechanism 776, as constructed in accordance with the principles and teachings of the present invention and showing the cooperative parts thereof, and which may likewise be utilized, for example, in conjunction with the strand applicator assembly 400 at the position illustrated by means of the strand positioning guide mechanism or implement 476 mounted upon the underside portion of the module assembly 412, is disclosed. It is noted that the third embodiment strand positioning guide mechanism or implement 776 is similar to the first and second embodiment strand positioning guide mechanisms or implements 576,676 as illustrated within FIGS. 4-7, except as will be noted hereinafter, and therefore the discussion of the third embodiment strand positioning guide mechanism or implement 776 will be confined to the differences between the third embodiment strand positioning guide mechanism or implement 776 as compared to the first and second embodiment strand positioning guide mechanisms or implements 576,676. In addition, it is also noted that component parts of the third embodiment strand positioning guide mechanism or implement 776, which correspond to similar component parts of the first and second embodiment strand positioning guide mechanisms or implements 576, 676, will be designated by corresponding reference characters except that they will be within the 700 series.

More particularly, the primary difference between the third embodiment strand positioning guide mechanism or implement 776, as compared to, for example, the second embodiment strand positioning guide mechanism or implement 676, is that, in lieu of the strand positioning guide block 782 being integrally connected to the underside or undersurface portion of the mounting plate 778 throughout the entire transverse or lateral extent thereof, as is characteristic of the integral connection of the strand positioning guide block 682 with respect to the mounting plate 678 of the second embodiment strand positioning guide mechanism or implement 676 as illustrated within FIG. 6, the strand positioning guide block 782 is fixedly connected to the underside or undersurface portion of the mounting plate 778 in a cantilevered manner as a result of only being integrally connected to the underside or undersurface portion of the mounting plate 778 at its right side or right end portion as can be appreciated from FIG. 8. In this manner, the remaining, or leftwardly extending, portion of the strand positioning guide block 782 is effectively spaced or separated from the underside or undersurface portion of the mounting plate 778 so as to effectively define a horizontally oriented insertion slot 794 into which, and by means of which, the plurality of strands 426 can be respectively inserted into the plurality of V-shaped guide slots 784 so as to be seated within the lower apex portions 792 thereof.

Thus, it may be seen that in accordance with the principles and teachings of the present invention, there has been disclosed new and improved strand positional guide implements or mechanisms, for use in connection with material dispensing and coating nozzles of, for example, hot melt adhesive strand coating applicator assemblies, wherein the strand positional guide implements or mechanisms comprise a plurality of strand guide slots which not only have substantially V-shaped cross-sectional configurations, but in particular, the apex portions of the V-shaped strand guide slots are disposed so as to be oriented outwardly or remotely away from the hot melt adhesive material dispensing assembly and the hot melt adhesive material dispensing nozzles thereof. In this manner, an enlarged air space is effectively defined between each one of the plurality of elongated strands and its respective hot melt adhesive material dispensing nozzle such that the plurality of elongated strands are not adversely affected by means of the heat or thermal radiation generated by or emanating from the hot melt adhesive material dispensing assembly and the hot melt adhesive material dispensing nozzles thereof. The V-shaped strand guide slots are defined within the strand positional guide implements or blocks, and a plurality of insertion slots are also defined within the strand positional guide implements or blocks so as to permit the plurality of elongated strands to be inserted into the respective V-shaped strand guide slots. Alternatively, the strand positional guide implement or block comprises a cantilevered structure integrally attached at one end thereof to a mounting plate, which is to be fixedly secured to the applicator module, whereby the strands may initially be inserted between the strand positional guide implement or block and the mounting plate, and then subsequently inserted into the individual V-shaped strand guide slots.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A strand guide system for guiding at least one elongated strand of material past a material dispensing apparatus such that material dispensed from the material dispensing apparatus can be properly coated upon the at least one elongated strand of material, comprising:

a material dispensing assembly having at least one material dispensing nozzle disposed thereon for dispensing a material to be coated upon at least one elongated strand of material as the at least one elongated strand of material is conveyed past said at least one material dispensing nozzle;

a module assembly for supplying the material to be dispensed to said material dispensing assembly and said at least one material dispensing nozzle disposed upon said material dispensing assembly;

structure for mounting said material dispensing assembly upon said module assembly; and a strand positioning guide mechanism mounted in a surface-to-surface contact manner upon said module assembly and having at least one strand guide slot defined therein for guiding the at least one elongated strand of material as the at least one elongated strand of material is conveyed past said at least one material dispensing nozzle, wherein said at least one strand guide slot has a substantially V-shaped, triangular cross-sectional configuration, comprising a base portion and an apex portion, and wherein, when said strand positioning guide mechanism is mounted upon an undersurface portion of said module assembly, said strand guide slot of said strand positioning guide mechanism is oriented such that said base portion is disposed beneath said at least one material dispensing nozzle while said apex portion of said at least one strand guide slot is located upon said strand positioning guide mechanism so as to be disposed beneath said base portion remote from said at least one material dispensing nozzle such that the at least one elongated strand of material will not be adversely affected by thermal radiation emanating from said at least one material dispensing nozzle.

2. The strand guide system as set forth in claim 1, wherein:

said strand positioning guide mechanism, having said at least one strand guide slot defined therein, has a plurality of laterally spaced strand guide slots defined therein; and said material dispensing assembly, having said at least one material dispensing nozzle disposed thereon for dispensing a material to be coated upon at least one elongated strand of material as the at least one elongated strand of material is conveyed past said at least one material dispensing nozzle, comprises a plurality of laterally spaced material dispensing nozzles for dispensing a material to be coated upon a plurality of laterally spaced elongated strands of material as the plurality of laterally spaced elongated strands of material are conveyed through said plurality of laterally spaced strand guide slots of said strand positioning guide mechanism and past said plurality of laterally spaced material dispensing nozzles.

3. The strand guide system as set forth in claim 2, wherein:

said strand positioning guide mechanism, having said plurality of laterally spaced strand guide slots defined therein, comprises three laterally spaced strand guide slots defined therein; and said material dispensing assembly, having said plurality of laterally spaced material dispensing nozzles disposed thereon for dispensing a material to be coated upon the plurality of laterally spaced elongated strands of material as the plurality of laterally spaced elongated strands of material are conveyed past said plurality of laterally spaced material dispensing nozzles, comprises three laterally spaced material dispensing nozzles for dispensing a material to be coated upon three laterally spaced elongated strands of material as the three laterally spaced elongated strands of material are conveyed through said three laterally spaced strand guide slots and past said three laterally spaced material dispensing nozzles.

4. The strand guide system as set forth in claim 2, wherein: said strand positioning guide mechanism is mounted upon an undersurface portion of said module assembly.

5. The strand guide system as set forth in claim 4, wherein: said plurality of laterally spaced material dispensing nozzles, disposed upon said material dispensing assembly, are oriented vertically downwardly so as to be capable of depositing the material onto the plurality of laterally spaced elongated strands of material which are being conveyed along substantially horizontally oriented paths of travel which extend through said plurality of laterally spaced strand guide slots defined within said strand positioning guide mechanism.

6. The strand guide system as set forth in claim 4, wherein said strand positioning guide mechanism comprises:

a mounting plate for mounting said strand positioning guide mechanism upon said module assembly; and a strand positioning guide block within which said plurality of laterally spaced strand guide slots are defined.

7. The strand guide system as set forth in claim 6, wherein: said mounting plate is disposed substantially horizontally so as to permit said strand positioning guide mechanism to be fixedly mounted upon said undersurface portion of said module assembly;

said strand positioning guide block is oriented substantially perpendicular to said mounting plate so as to extend substantially vertically downwardly; and said plurality of laterally spaced strand guide slots extend substantially horizontally through said vertically oriented strand positioning guide block so as to permit the plurality of laterally spaced elongated strands to pass through said plurality of laterally spaced strand guide slots along substantially horizontally oriented paths of travel.

8. The strand guide system as set forth in claim 7, further comprising:

a plurality of laterally spaced insertion slots defined within said strand positioning guide block and respectively intersecting said plurality of laterally spaced strand guide slots so as to permit the plurality of elongated strands of material to be inserted into said plurality of laterally spaced strand guide slots.

9. The strand guide system as set forth in claim 7, wherein: said strand positioning guide block is fixedly connected to said mounting plate in a cantilevered manner; and a horizontally oriented insertion slot is defined between said strand positioning guide block and said mounting plate so as to permit the plurality of elongated strands of material to be inserted into said plurality of laterally spaced strand guide slots.

10. The strand guide system as set forth in claim 2, further comprising:

vacuum passageway means defined within said strand positioning guide mechanism for removing lubrication material, which was disposed upon the plurality of laterally spaced elongated strands of material and which may accumulate upon said strand positioning guide mechanism, so as to prevent the lubrication material from fouling said plurality of laterally spaced dispensing nozzles.

11. A strand guide system for guiding at least one elongated strand of material past a material dispensing apparatus such that material dispensed from the material dispensing apparatus can be properly coated upon the at least one elongated strand of material, comprising:

a material dispensing assembly having at least one material dispensing nozzle disposed thereon for dispensing a material to be coated upon at least one elongated strand of material as the at least one elongated strand of material is conveyed past said at least one material dispensing nozzle;

a module assembly for supplying the material to be dispensed to said material dispensing assembly and said at least one material dispensing nozzle disposed upon said material dispensing assembly;

structure for mounting said material dispensing assembly upon said module assembly; and a strand positioning guide mechanism mounted in a surface-to-surface contact manner upon said module assembly and having at least one strand guide slot defined therein for guiding the at least one elongated strand of material as the at least one elongated strand of material is conveyed past said at least one material dispensing nozzle, wherein said at least one strand guide slot has a substantially V-shaped, triangular cross-sectional configuration, comprising a base portion and an apex portion, and wherein, when said strand positioning guide mechanism is mounted upon an undersurface portion of said module assembly, said strand guide slot of said strand positioning guide mechanism is oriented such that said base portion is disposed beneath said at least one material dispensing nozzle while said apex portion of said at least one strand guide slot is located upon said strand positioning guide mechanism so as to be disposed beneath said base portion remote from said at least one material dispensing nozzle whereby the at least one elongated strand of material will be spaced a predetermined distance from said material dispensing assembly, having said at least one material dispensing nozzle disposed thereon, so as not to be adversely affected by thermal radiation emanating from said material dispensing assembly and said at least one material dispensing nozzle disposed thereon.

12. The strand guide system as set forth in claim 11, wherein:

said strand positioning guide mechanism, having said at least one strand guide slot defined therein, has a plurality of laterally spaced strand guide slots defined therein; and said material dispensing assembly, having said at least one material dispensing nozzle disposed thereon for dispensing a material to be coated upon at least one elongated strand of material as the at least one elongated strand of material is conveyed past said at least one material dispensing nozzle, comprises a plurality of laterally spaced material dispensing nozzles for dispensing a material to be coated upon a plurality of laterally spaced elongated strands of material as the plurality of laterally spaced elongated strands of material are conveyed through said plurality of laterally spaced strand guide slots of said strand positioning guide mechanism and past said plurality of laterally spaced material dispensing nozzles.

13. The strand guide system as set forth in claim 12, wherein:

said strand positioning guide mechanism, having said plurality of laterally spaced strand guide slots defined therein, comprises three laterally spaced strand guide slots defined therein; and said material dispensing assembly, having said plurality of laterally spaced material dispensing nozzles disposed thereon for dispensing a material to be coated upon the plurality of laterally spaced elongated strands of material as the plurality of laterally spaced elongated strands of material are conveyed past said plurality of laterally spaced material dispensing nozzles, comprises three laterally spaced material dispensing nozzles for dispensing a material to be coated upon three laterally spaced elongated strands of material as the three laterally spaced elongated strands of material are conveyed through said three laterally spaced strand guide slots and past said three laterally spaced material dispensing nozzles.

14. The strand guide system as set forth in claim 12, wherein:

said strand positioning guide mechanism is mounted upon an undersurface portion of said module assembly.

15. The strand guide system as set forth in claim 14, wherein:

said plurality of laterally spaced material dispensing nozzles, disposed upon said material dispensing assembly, are oriented vertically downwardly so as to be capable of depositing the material onto the plurality of laterally spaced elongated strands of material which are being conveyed along substantially horizontally oriented paths of travel which extend through said plurality of laterally spaced strand guide slots defined within said strand positioning guide mechanism.

16. The strand guide system as set forth in claim 14, wherein said strand positioning guide mechanism comprises:

a mounting plate for mounting said strand positioning guide mechanism upon said module assembly; and a strand positioning guide block within which said plurality of laterally spaced strand guide slots are defined.

17. The strand guide system as set forth in claim 16, wherein:

said mounting plate is disposed substantially horizontally so as to permit said strand positioning guide mechanism to be fixedly mounted upon said undersurface portion of said module assembly;

said strand positioning guide block is oriented substantially perpendicular to said mounting plate so as to extend substantially vertically downwardly; and said plurality of laterally spaced strand guide slots extend substantially horizontally through said vertically oriented strand positioning guide block so as to permit the plurality of laterally spaced elongated strands to pass through said plurality of laterally spaced strand guide slots along substantially horizontally oriented paths of travel.

18. The strand guide system as set forth in claim 17, further comprising:

a plurality of laterally spaced insertion slots defined within said strand positioning guide block and respectively intersecting said plurality of laterally spaced strand guide slots so as to permit the plurality of elongated strands of material to be inserted into said plurality of laterally spaced strand guide slots.

19. The strand guide system as set forth in claim 17, wherein:

said strand positioning guide block is fixedly connected to said mounting plate in a cantilevered manner; and a horizontally oriented insertion slot is defined between said strand positioning guide block and said mounting plate so as to permit the plurality of elongated strands of material to be inserted into said plurality of laterally spaced strand guide slots.

20. The strand guide system as set forth in claim 12, further comprising:

vacuum passageway means defined within said strand positioning guide mechanism for removing lubrication material, which was disposed upon the plurality of laterally spaced elongated strands of material and which may accumulate upon said strand positioning guide mechanism, so as to prevent the lubrication material from fouling said plurality of laterally spaced dispensing nozzles.

* * * * *